US010544756B2

(12) United States Patent
Xue

(10) Patent No.: US 10,544,756 B2
(45) Date of Patent: Jan. 28, 2020

(54) DUAL FUEL CARBURETOR

(71) Applicant: Meiying Xue, Hangzhou (CN)

(72) Inventor: Meiying Xue, Hangzhou (CN)

( * ) Notice: Subject to any disclaimer, the term of this patent is extended or adjusted under 35 U.S.C. 154(b) by 362 days.

(21) Appl. No.: 15/626,610

(22) Filed: Jun. 19, 2017

(65) Prior Publication Data

US 2017/0284341 A1 Oct. 5, 2017

(30) Foreign Application Priority Data

Oct. 14, 2016 (CN) ..... 2016 1 0899024

(51) Int. Cl.

| | |
|---|---|
| ***F02M 13/08*** | (2006.01) |
| ***F02M 19/04*** | (2006.01) |
| ***F02M 19/08*** | (2006.01) |
| *F02M 7/14* | (2006.01) |
| *F02B 25/20* | (2006.01) |
| *F02M 7/18* | (2006.01) |

(52) U.S. Cl.

CPC ..... *F02M 13/08* (2013.01); *F02M 19/04* (2013.01); *F02M 19/08* (2013.01); *F02B 25/20* (2013.01); *F02M 7/14* (2013.01); *F02M 7/18* (2013.01)

(58) Field of Classification Search

CPC ..... F02M 19/04; F02M 7/14; F02M 7/18; F02M 13/08; F02M 19/08; F02M 19/00; F02M 7/12; F02B 25/20

See application file for complete search history.

(56) References Cited

U.S. PATENT DOCUMENTS

| | | | | | |
|---|---|---|---|---|---|
| 1,524,865 | A * | 2/1925 | Hughes | F02M 7/18 | 251/257 |
| 2,902,045 | A * | 9/1959 | Lunn | F02M 1/00 | 137/400 |
| 3,689,036 | A * | 9/1972 | Kikuchi | F02M 7/04 | 261/34.2 |
| 4,129,620 | A * | 12/1978 | Etoh | F02M 13/06 | 123/575 |
| 4,333,886 | A * | 6/1982 | Mitsui | F02M 13/06 | 123/575 |

(Continued)

FOREIGN PATENT DOCUMENTS

| | | |
|---|---|---|
| CN | 86205329 U | 9/1987 |
| CN | 201723334 U | 1/2011 |

(Continued)

*Primary Examiner* — Stephen Hobson
(74) *Attorney, Agent, or Firm* — Shimokaji IP

(57) ABSTRACT

A dual fuel carburetor includes a carburetor body, a main jet pipe and a float chamber housing to form a float chamber, the needle valve device includes a pushing needle and a needle valve base, the pushing needle is movably inserted in the float chamber housing, and a window is formed at a bottom of the float chamber housing, the needle valve device further includes a sealed corrugated sleeve positioned around the pushing needle, which has a first end hermetically connected with the pushing needle and a second end hermetically connected with the float chamber housing, a driving spring is positioned around the pushing needle, and the pushing needle has a driving end extended out from the float chamber housing and opposite to that end cooperated with the valve base hole. The needle valve device is in a reasonable design to obtain mechanical controls or other automated drive controls.

9 Claims, 6 Drawing Sheets

A-A

(56) References Cited

U.S. PATENT DOCUMENTS

| | | | | | |
|---|---|---|---|---|---|
| 4,437,448 | A * | 3/1984 | Billingsley | F02M 1/16 | 123/179.9 |
| RE32,938 | E * | 6/1989 | Haman | F02B 61/045 | 123/179.11 |
| 5,537,979 | A * | 7/1996 | Nuti | F02B 25/20 | 123/438 |
| 6,082,323 | A * | 7/2000 | Winberg | F02M 7/12 | 123/198 DB |
| 6,655,665 | B2 * | 12/2003 | Magnani | F02M 19/04 | 261/71 |
| 6,685,105 | B1 * | 2/2004 | Ruehle | F02M 51/0603 | 239/102.1 |

FOREIGN PATENT DOCUMENTS

| | | | |
|---|---|---|---|
| CN | 202391414 | U | 8/2012 |
| CN | 203175705 | U | 9/2013 |
| CN | 104481736 | A | 4/2015 |
| CN | 206111374 | U | 4/2017 |

* cited by examiner

A-A

DUAL FUEL CARBURETOR

RELATED APPLICATIONS

This application claims the benefits of Chinese Patent Application No. 201610899024.4, filed on Oct. 14, 2016, the entire contents of which are hereby incorporated by reference in this application.

FIELD OF THE INVENTION

The present invention relates to a carburetor, and more particularly to a dual fuel carburetor of a dual fuel energy which is applicable to both liquid fuel and gaseous fuel.

BACKGROUND OF THE INVENTION

Carburetors are equipments that mix the proportional gasoline with air in a vacuum condition generated by an engine so as to supply mixed gas to the engine. The carburetor is called as a heart of the engine due to its significant function, which mainly includes a start-up device, an idling device, a medium load device, a full load device and an accelerator. The carburetor can automatically prepare the desired mixed gas accordingly to different working status of the engine and output the mixed gas, further, the carburetor may atomize the fuel oil to make sure the uniformity of the mixed gas.

Dual fuel engines are new type engines that are able to use liquid fuel such as gasoline and gaseous fuel such as liquefied petroleum gas (LPG) or natural gas, which have good prospects due to high efficiency and low pollutant emission.

As shown in FIG. 1, a current dual fuel carburetor includes a carburetor body 1' and a float chamber housing 2' covered on the carburetor body 1', and a float chamber 3' is formed within the float chamber housing 2'. A main jet pipe 4' is provided on the carburetor body 1' to cooperate with the float chamber 3', a main metering jet 5' is provided on the fuel inlet end of the main jet pipe 4', and a needle valve device is formed between the main metering jet 5' and the float chamber 3' to control the connection and disconnection therebetween. The needle valve device includes a pushing needle 6' and a needle valve base 8' cooperated with the pushing needle, and the needle valve base 8' includes a valve base hole 81' cooperated with the pushing needle 6' and an fuel inlet 82' communicated with the float chamber 3', and the valve base hole 81' is communicated with the main metering jet 5'. The pushing needle 6' is driven by an electromagnetic valve 7' which is mounted on the float chamber housing 2'. Conventionally, the pushing needle 6' is integrated with the electromagnetic valve 7', thus the pushing needle 6' must be controlled by the electromagnetic valve 7' which requires to be energized continuously during the operation, as a result, the electromagnetic valve 7' may be damaged due to the long-term and continuous energization for the coils to make the carburetor unreliable.

SUMMARY OF THE INVENTION

For overcoming the drawing backs of the conventional carburetor, the present invention provides an improved and reliable dual fuel carburetor with an revised needle valve device, thereby obtaining mechanical controls or other automated drive controls.

The present invention provides a dual fuel carburetor, comprising a carburetor body, a main jet pipe, and a float chamber housing covered on the carburetor body to form a float chamber, a main metering jet being provided on a fuel inlet end of the main jet pipe, and a needle valve device being formed between the main metering jet and the float chamber to control their connection or disconnection, the needle valve device comprising a pushing needle and a needle valve base which has a valve base hole cooperated with the pushing needle and a fuel inlet communicated with the float chamber, the pushing needle being movably inserted in the float chamber housing along an axis thereof, and a window being formed at a bottom of the float chamber housing to allow the pushing needle to pass through, wherein the needle valve device further comprises a sealed corrugated sleeve positioned around the pushing needle, which has a first end hermetically connected with the pushing needle and a second end hermetically connected with the float chamber housing, a driving spring is positioned around the pushing needle to urge it to block the valve base hole, and the pushing needle has a driving end which is extended out from the float chamber housing and is opposite to that end cooperated with the valve base hole.

In comparison with the prior art, because a fitting connection between the pushing needle and the float chamber housing is achieved by the sealed corrugated sleeve, and the pushing needle is driven by the driving spring to turn off the valve base hole, thus the pushing needle can be fitted independently on the carburetor; and the pushing needle has a driving end that is extended out from the float chamber housing, thus it is beneficial to be driven manually and mechanically or by other automated drive devices, which can be chosen by users. Furthermore, the device has simple structure, reduced manufacturing cost and stable operation.

Preferably, the sealed corrugated sleeve is formed by an integrated rubber sleeve. In such a configuration, the sealed corrugated sleeve is easy to be assembled and disassembled, thereby reducing the cost.

Preferably, an annular retaining groove is formed on the pushing needle, a bulged rubber ring is integrated with the first end of the seal corrugated sleeve, and the bulged rubber ring is embedded in the annular retaining groove. In such a configuration, the tight fitting between the sealed corrugated sleeve and the pushing needle is more stable.

Preferably, a gasket is provided at the second end of the sealed corrugated sleeve and extended outwards along a radial direction of the sealed corrugated sleeve, a plate with a through hole is mounted on the float chamber housing, and the plate and the float chamber housing are in tight fitting by virtue of the gasket.

Preferably, the driving spring is located in the sealed corrugated sleeve, a flange is radially protruded from the pushing needle, one end of the driving spring is pressed against the flange, and another end of the driving spring is pressed on the float chamber housing.

Preferably, one end of the sealed corrugated sleeve is extended from the window of the float chamber housing, the gasket is pressed against an outer bottom of the float chamber housing, the plate is mounted on the outer bottom of the float chamber housing, and the driving spring is pressed against the plate to make the driving spring be pressed on the float chamber housing.

Preferably, a rocker arm is pivotally connected to a bottom of the floating chamber housing and arranged along a radial direction of the pushing needle, the rocker arm comprises a first swing arm and a second swing arm which are respectively configured at two sides of a swing fulcrum, and the second swing arm is in a linkage connection with the pushing needle.

Preferably, the main metering jet is formed on the needle valve base.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
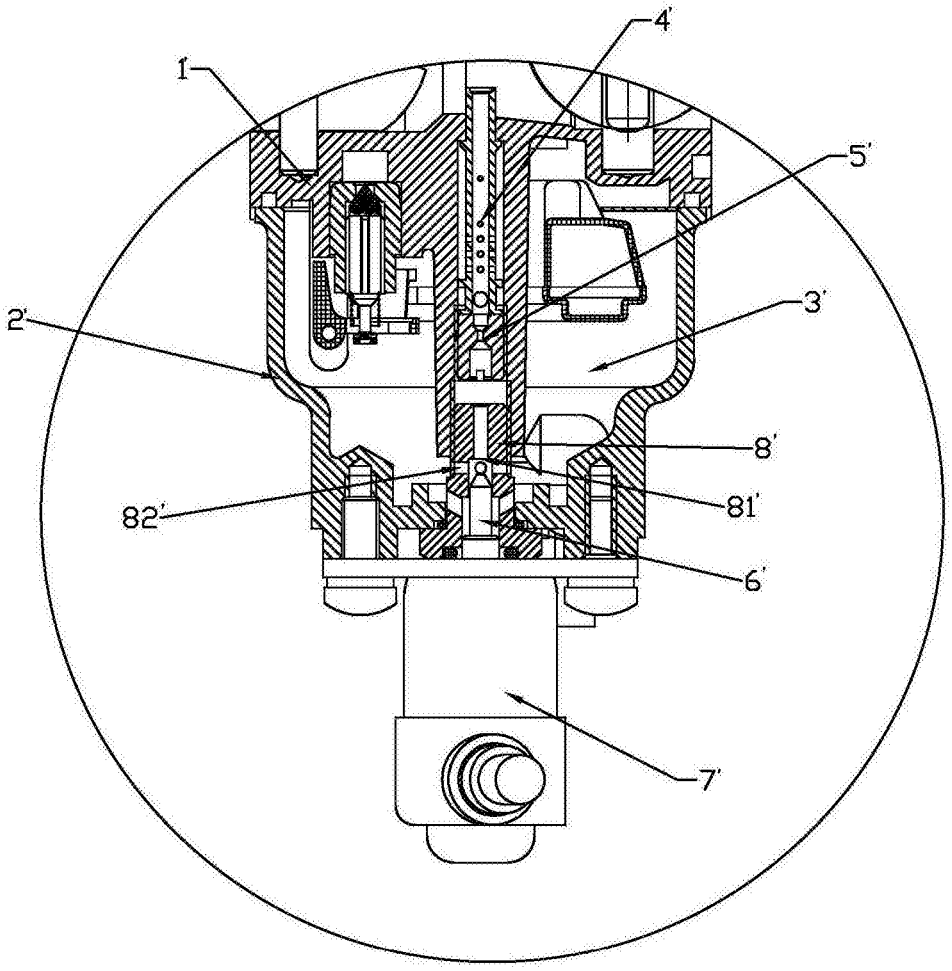
Fig. 1(Prior art)
FIG. 1 is a sectional view of a conventional dual fuel carburetor.
Figure 2:
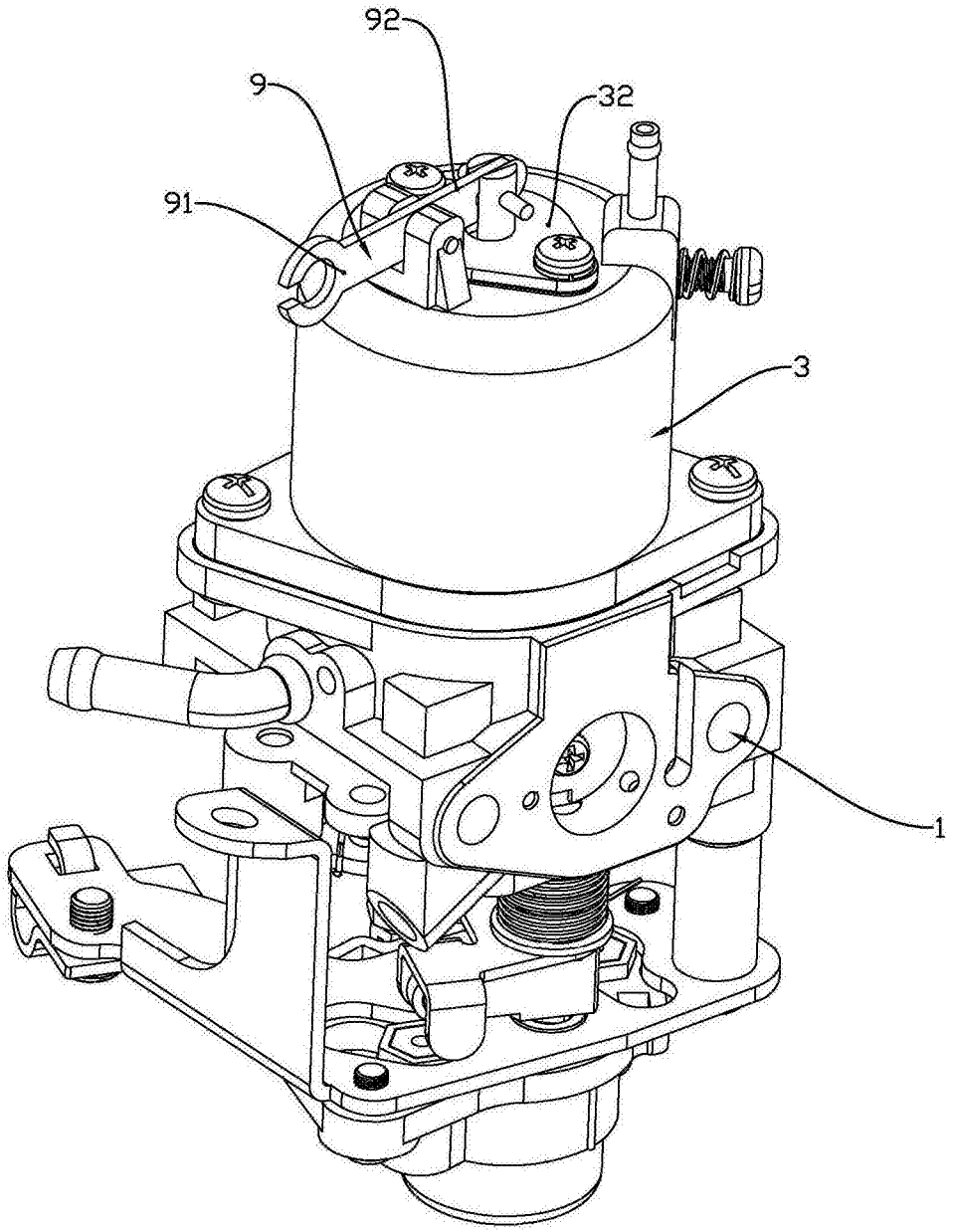
FIG. 2 is a perspective view of a dual fuel carburetor according to an embodiment of the present invention.
Figure 3:
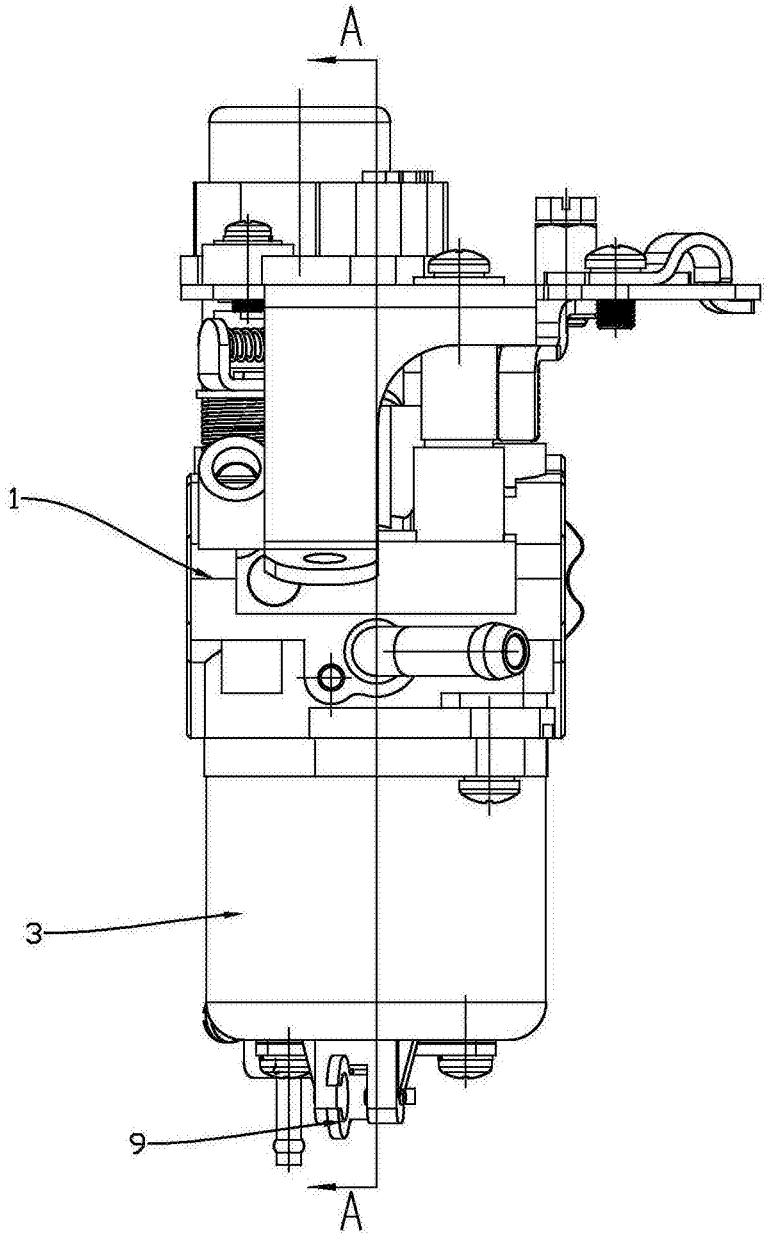
FIG. 3 is a side view of the dual fuel carburetor.
Figure 4:
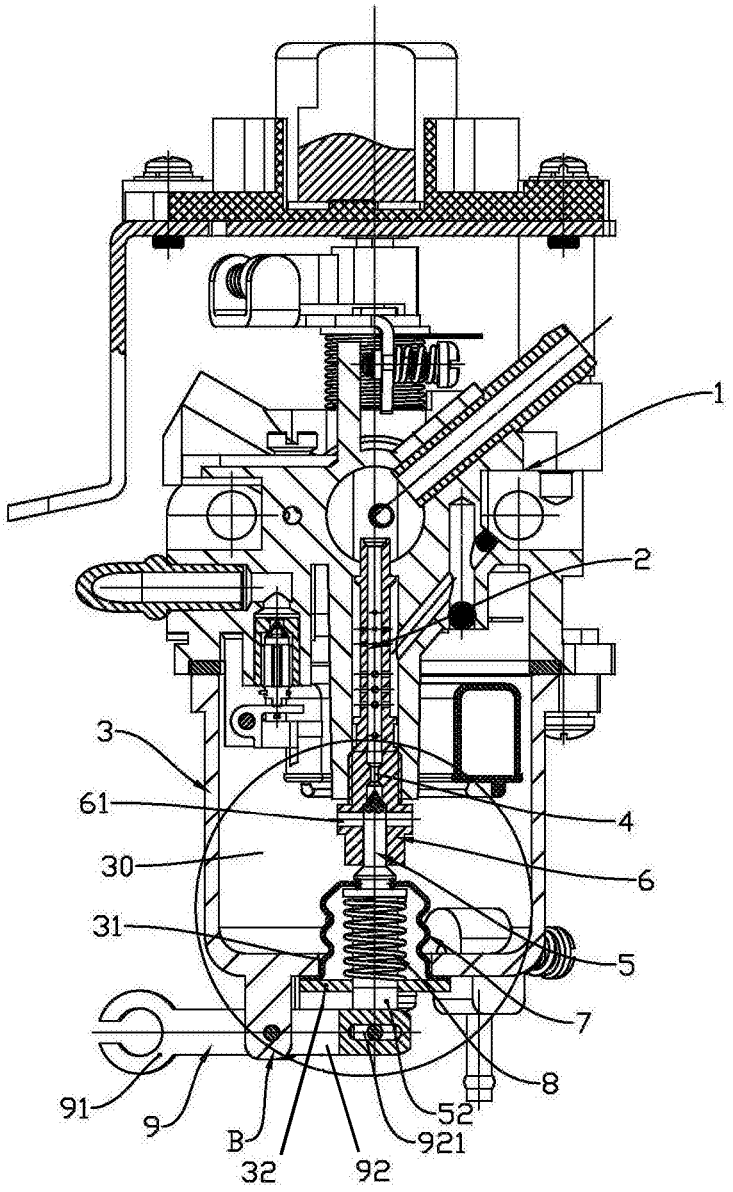
FIG. 4 is a sectional view of the dual fuel carburetor along A-A line of FIG. 3.
Figure 5:
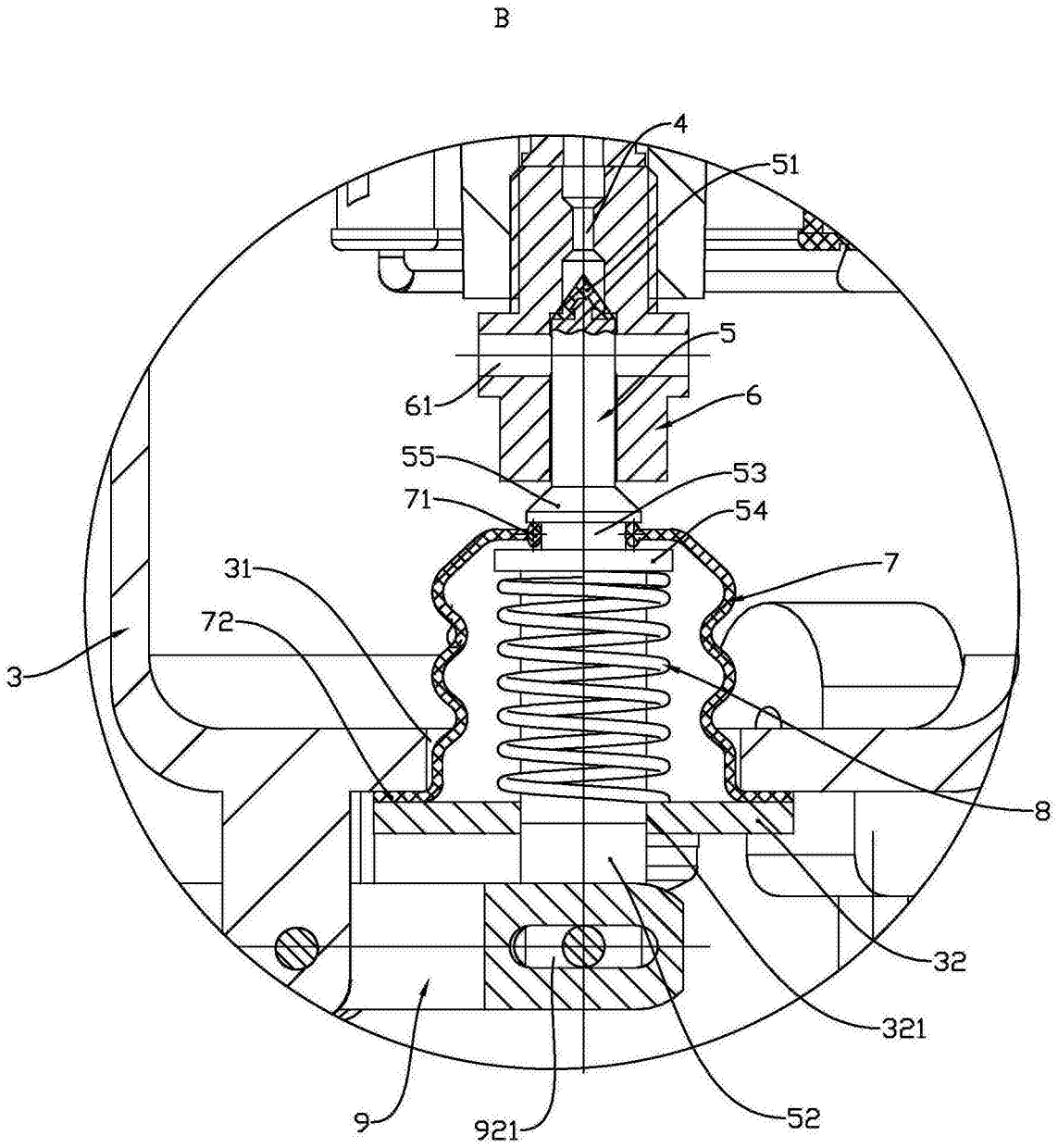
FIG. 5 is a partial enlarged view of the B portion of FIG. 4.
Figure 6:
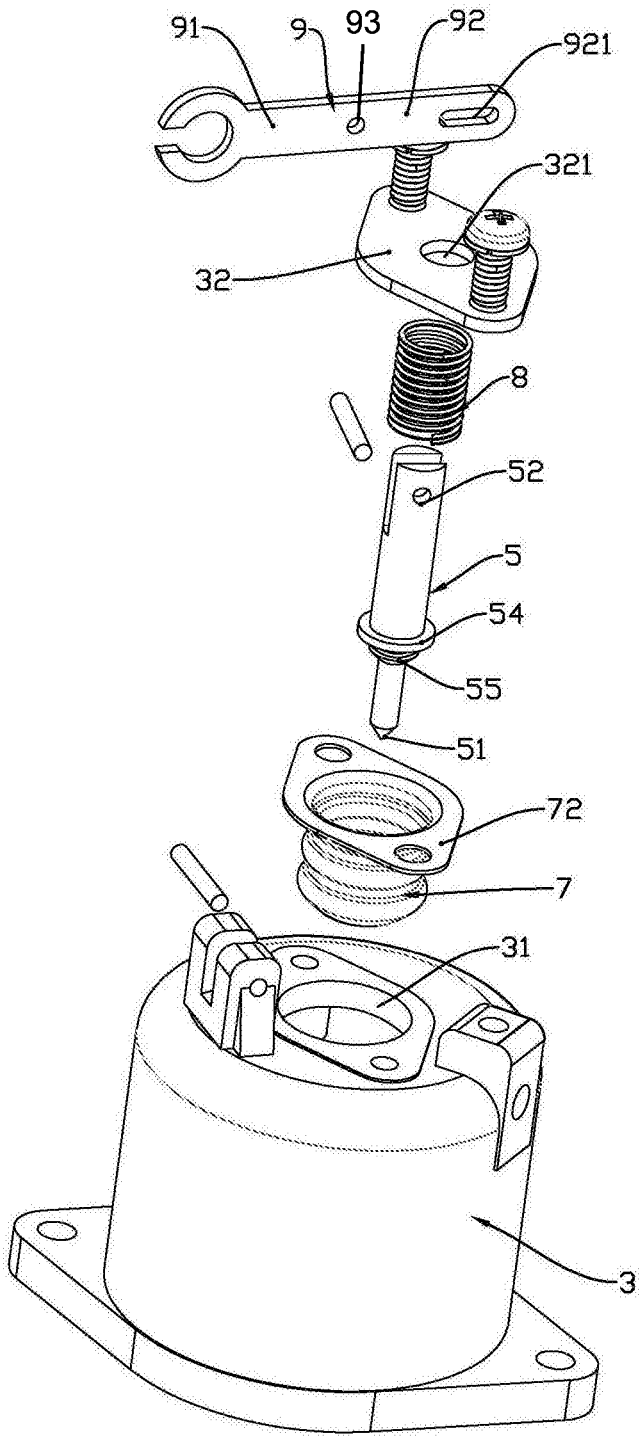
FIG. 6 is an exploded view of the needle valve device and the float chamber housing.

As illustrated in FIGS. 2-6, a dual fuel carburetor according to the present invention includes a carburetor body 1, a main jet pipe 2 and a float chamber housing 3 covered on the carburetor body 1 and with a float chamber 30 formed therein. A main measure hole 4 is provided on a fuel inlet end of the main jet pipe 2, and a needle valve device formed between the main measure hole 4 and the float chamber 30 to control their connection and disconnection. The needle valve device includes a pushing needle 5 and a needle valve base 6 that is provided with a valve base hole matching with the pushing needle and a fuel inlet 61 communicating with the float chamber 30. The pushing needle 5 has a valve core end which is cooperated with the valve base hole of the needle valve base 6. For improving the sealing effect between the valve core end and the valve base hole, the valve core end is a rubber head 51, concretely, the rubber head 51 is firmly connected to a cone head of the pushing needle 5. Specifically, the pushing needle 5 is movably inserted in the float chamber housing 3 along an axis of the pushing needle 5, a window 31 is formed at the bottom of the float chamber housing 3 through which the pushing needle is extended. The needle valve device further includes a sealed corrugated sleeve 7 positioned around the pushing needle 5, one end of which is hermetically connected with the pushing needle 5, and the other end of which is hermetically connected with the float chamber housing 3. A driving spring 8 is positioned around the pushing needle 5 to urge the pushing needle 5 to block the valve base hole, and the pushing needle 5 has a driving end 52 which is extended out from the float chamber housing 3 and is opposite to that end cooperated with the valve base hole. Specifically, the sealed corrugated sleeve 7 will be extended or contracted while the pushing needle 5 is sliding, one end of the sealed corrugated sleeve 7 is hermetically connected with the pushing needle 5 to move along with the pushing needle 5, and the other end of the sealed corrugated sleeve 7 is hermetically connected with the float chamber housing 3, thereby obtaining a reliable tight fitting between the pushing needle 5 and the sealed corrugated sleeve 7, furthermore the pushing needle 5 is driven by the driving spring 8 to block the valve base hole, thus the pushing needle 5 can be fitted independently on the carburetor. And the pushing needle 5 has a driving end that is extended out from the float chamber housing 3, thus it is beneficial to be driven manually and mechanically or by other automated drive devices, which can be chosen by users. Especially, the user can select the mechanical operation that is more reliable to control the connection and disconnection of the fuel supplying.

In the specific embodiment, the sealed corrugated sleeve 7 is preferably formed by an integrated rubber sleeve which brings a reduced cost and simple assembly. Of course, the sealed corrugated sleeve 7 can be a metal corrugated sleeve, or a member having a deformable corrugated rubber element at the middle and a metal element at the ends. For ensuring the good tightness between the sealed corrugated sleeve 7 and the pushing needle 5, an annular retaining groove 53 is formed on the pushing needle 5, and an expanded rubber ring 71 is provided at the end of the sealed corrugated sleeve 7 which is embedded in the retaining groove 53. The expanded rubber ring 71 can increase the thickness of the end of the sealed corrugated sleeve 7, thus the connection between the sealed corrugated sleeve 7 and the pushing needle 5 is more stable to keep the reliable tightness.

For ensuring the reliable tightness between the sealed corrugated sleeve 7 and the float chamber housing 3, a gasket 72 is provided at the other end of the sealed corrugated sleeve 7 and extended outwards and radially, a plate 32 with a through hole 321 is mounted on the float chamber housing 3, by virtue of which the gasket 72 is pressed against the float chamber housing to achieve a sealing fit of the sealed corrugated sleeve 7 and the float chamber housing 3. In such a way, the tightness between the sealed corrugated sleeve 7 and the float chamber housing 3 is ensured. As other options, the float chamber housing is extended inwards along the window to form a sleeve joint, and the sealed corrugated sleeve 7 is wound on the sleeve joint to achieve the tight fitting; or rigid connectors are integrated with the sealed corrugated sleeve 7, the tight fitting is achieved by virtue of threaded fit of the rigid connectors. The gasket 72 and the bottom of the float chamber housing 3 are in tight fitting, and the gasket 72 is pressed against the plate 32 inside the float chamber housing 3. Alternatively as shown in the present embodiment, one end of the sealed corrugated sleeve 7 is extended from the window 31 of the float chamber housing 3, the gasket 72 is press against the outer bottom of the float chamber housing 3, and the plate 32 is mounted on the outer bottom of the float chamber housing 3; in such a configuration, the assembly and the disassembly are more convenient.

In addition, the driving spring 8 is positioned in the sealed corrugated sleeve 7, a flange 54 is radially protruded from the pushing needle 5, one end of the driving spring 8 is pressed against the flange 54, and the other end of the driving spring 8 is pressed on the float chamber housing 3. Based on the position of the driving spring 8, the structure of the device is more compact. Furthermore, a collar 55 is formed on the pushing needle 5 and adjacent to the flange 54, and a retaining groove 53 is formed between the collar 55 and the flange 54.

Further, the driving spring 8 is pressed against the plate 32 to make the driving spring 8 insert into the float chamber housing 3. In such a configuration, the assembly and the disassembly of the device are convenient. Under a case of that a plate in the float chamber housing is used to pressed against the gasket, the driving spring can be configured at the bottom of the float chamber housing.

For facilitating the driving motion of the needle valve device and the assembly, a rocker arm 9 is pivotally connected to the bottom of the floating chamber housing 3 and is arranged along the radial direction of the pushing needle 5. Specifically, the rocker arm 9 includes a first swing arm 91 and a second swing arm 92 which are respectively configured at two sides of the swing fulcrum 93. The second swing arm 92 is in linkage connection with the pushing needle 5, as a result, the pushing needle 5 will be driven as the swing motion of the rocker arm 9. As illustrated, the second swing arm 92 of the rocker arm 9 is provided with a strip hole 921, a driving end of the pushing needle 5 is connected to a hinge shaft which is inserted in the strip hole 921, so as to achieve the linkage connection between the rocker arm 9 and the pushing needle 5. Of course, the linkage connection can be achieved by aligning the end of the rocker arm and the pushing needle and then pushing the pushing needle.

In this embodiment, the main metering jet 4 is formed on the needle valve base 6 directly, instead of using an individual measurement hole, thus the mount of the elements is reduced to eliminate a fit clearance between the individual measurement hole and the valve base hole to improve fuel feeding efficiency.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A dual fuel carburetor, comprising a carburetor body, a main jet pipe, and a float chamber housing covered on the carburetor body to form a float chamber, a main metering jet being provided on a fuel inlet end of the main jet pipe, and a needle valve device being formed between the main metering jet and the float chamber to control their connection or disconnection, the needle valve device comprising a pushing needle and a needle valve base which has a valve base hole cooperated with the pushing needle and a fuel inlet communicated with the float chamber, the pushing needle being movably inserted in the float chamber housing along an axis thereof, and a window being formed at a bottom of the float chamber housing to allow the pushing needle to pass through, wherein the needle valve device further comprises a sealed corrugated sleeve positioned around the pushing needle, which has a first end hermetically connected with the pushing needle and a second end hermetically connected with the float chamber housing, a driving spring is positioned around the pushing needle to urge the pushing needle to block the valve base hole, and the pushing needle has a driving end which is extended out from the float chamber housing and is opposite to that end cooperated with the valve base hole.

2. The dual fuel carburetor according to claim 1, wherein the sealed corrugated sleeve is formed by an integrated rubber sleeve.

3. The dual fuel carburetor according to claim 2, wherein an annular retaining groove is formed on the pushing needle, a bulged rubber ring is integrated with the first end of the seal corrugated sleeve, and the bulged rubber ring is embedded in the annular retaining groove.

4. The dual fuel carburetor according to claim 2, wherein a gasket is provided at the second end of the sealed corrugated sleeve and extended outwards along a radial direction of the sealed corrugated sleeve, a plate with a through hole is mounted on the float chamber housing, and the plate and the float chamber housing are in tight fitting by virtue of the gasket.

5. The dual fuel carburetor according to claim 4, wherein the driving spring is located in the sealed corrugated sleeve, a flange is radially protruded from the pushing needle, one end of the driving spring is pressed against the flange, and another end of the driving spring is pressed on the float chamber housing.

6. The dual fuel carburetor according to claim 5, wherein one end of the sealed corrugated sleeve is extended from the window of the float chamber housing, the gasket is pressed against an outer bottom of the float chamber housing, the plate is mounted on the outer bottom of the float chamber housing, and the driving spring is pressed against the plate to make the driving spring be pressed on the float chamber housing.

7. The dual fuel carburetor according to claim 1, wherein the driving spring is located in the sealed corrugated sleeve, a flange is radially protruded from the pushing needle, one end of the driving spring is pressed against the flange, and another end of the driving spring is pressed on the float chamber housing.

8. The dual fuel carburetor according to claim 1, wherein a rocker arm is pivotally connected to a bottom of the floating chamber housing and arranged along a radial direction of the pushing needle, the rocker arm comprises a first swing arm and a second swing arm which are respectively configured at two sides of a swing fulcrum, and the second swing arm is in a linkage connection with the pushing needle.

9. The dual fuel carburetor according to claim 1, wherein the main metering jet is formed on the needle valve base.

* * * * *